US008419360B2

(12) United States Patent
Yamasaki et al.

(10) Patent No.: US 8,419,360 B2
(45) Date of Patent: Apr. 16, 2013

(54) MULTI-BLADE CENTRIFUGAL FAN

(75) Inventors: Takahiro Yamasaki, Sakai (JP); Akira Komatsu, Sakai (JP); Tooru Iwata, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1227 days.

(21) Appl. No.: 12/083,002

(22) PCT Filed: Nov. 24, 2006

(86) PCT No.: PCT/JP2006/323449

§ 371 (c)(1),
(2), (4) Date: Apr. 2, 2008

(87) PCT Pub. No.: WO2007/061051

PCT Pub. Date: May 31, 2007

(65) Prior Publication Data

US 2009/0129919 A1 May 21, 2009

(30) Foreign Application Priority Data

Nov. 25, 2005 (JP) ..... 2005-340331

(51) Int. Cl.
*F04D 29/28* (2006.01)

(52) U.S. Cl.
USPC ..... 415/206; 416/187

(58) Field of Classification Search ..... 415/119, 415/205, 206; 416/187, 195
See application file for complete search history.

(56) References Cited

U.S. PATENT DOCUMENTS 1,038,110 A * 9/1912 Foss ..... 416/178
1,646,897 A * 10/1927 Burns ..... 74/574.4
2,195,869 A * 4/1940 Rathbun ..... 416/185
3,288,356 A * 11/1966 Laing ..... 416/187
4,432,694 A * 2/1984 Kuroda et al. ..... 415/172.1
5,013,215 A * 5/1991 Diehl ..... 416/178
5,281,106 A * 1/1994 Reinhardt et al. ..... 417/354
5,352,089 A * 10/1994 Tokunaga et al. ..... 415/206
5,474,422 A * 12/1995 Sullivan ..... 415/206
5,511,939 A * 4/1996 Tokunaga et al. ..... 415/206
5,927,947 A * 7/1999 Botros ..... 416/144

(Continued)

FOREIGN PATENT DOCUMENTS

JP 2-33498 A 2/1990
JP 7-279891 A 10/1995

(Continued)

*Primary Examiner* — Edward Look
*Assistant Examiner* — Liam McDowell
(74) *Attorney, Agent, or Firm* — Birch, Stewart, Kolasch & Birch, LLP

(57) ABSTRACT

A multi-blade centrifugal fan for preventing circular flows in the end portions of an impeller in the axial direction is provided in a simple structure. The multi-blade centrifugal fan is formed of a fan casing of a scroll type and a multi-blade centrifugal impeller. The fan casing has a bellmouth which becomes an air intake. The multi-blade centrifugal impeller has a number of annularly arranged blades inside the fan casing. The centrifugal impeller draws in air through the intake, which faces the bellmouth, and blows out the air in the centrifugal direction through the blades. A retainer ring is provided in an outer peripheral end portion of the impeller. A cylindrical body is integrally provided in such a manner as to extend from the outer end of the retainer ring, so that circular flows toward the intake side are prevented in the end portions of the impeller.

5 Claims, 7 Drawing Sheets

U.S. PATENT DOCUMENTS

| | | | | |
|---|---|---|---|---|
| 6,299,409 | B1 * | 10/2001 | Matsunaga et al. | 415/206 |
| 6,604,906 | B2 * | 8/2003 | Ozeki et al. | 415/204 |
| 6,893,220 | B2 * | 5/2005 | Eaton et al. | 415/206 |
| 7,152,425 | B2 * | 12/2006 | Han et al. | 62/419 |
| 7,244,099 | B2 * | 7/2007 | Yamasaki | 415/173.6 |
| 2002/0025253 | A1 | 2/2002 | Ozeki et al. | |

FOREIGN PATENT DOCUMENTS

| | | | |
|---|---|---|---|
| JP | 8-303390 | A | 11/1996 |
| JP | 2001-173596 | A | 6/2001 |
| JP | 2002-48097 | A | 2/2002 |

* cited by examiner

MULTI-BLADE CENTRIFUGAL FAN

TECHNICAL FIELD

The present invention relates to a multi-blade centrifugal fan with a multi-blade centrifugal impeller placed within a fan casing.

BACKGROUND ART

As shown in FIGS. 11 and 12, a conventional multi-blade centrifugal fan is formed of a fan casing 1 and a multi-blade centrifugal impeller 2. The fan casing 1 is provided with bellmouths 4 each forming an air intake. A number of blades 6 are annularly arranged in the impeller 2, which blows out air W drawn in through the intakes 7 which face the above described bellmouths 4 in the centrifugal direction through the above described blades 6. The outer peripheral end portions of the above described impeller 2 are provided with retainer rings 10 for retaining the above described blades 6 (see Patent Document 1). The impeller 2 is provided with a main plate 8 and a bearing 9.

Patent Document 1: Japanese Laid-Open Patent Publication 2001-173596

DISCLOSURE OF THE INVENTION

In the case of the multi-blade centrifugal fan disclosed in the above described Patent Document 1, air W drawn in through the bellmouths 4 passes through the intakes 7 and the inside of the impeller 2 so as to be blown out in the centrifugal direction through the blades 6, and then flows out into the fan casing 1. However, circular flows W' are created around the end portions of the impeller 2, that is to say, around the retainer rings 10 provided in the vicinity of the intakes 7. When these circular flows W' are created, the efficiency in the blowing of wind of the multi-blade centrifugal fan lowers, and noise is inevitably increased.

The present invention is provided in view of the above described points, and an objective thereof is to prevent circular flows in the end portions of the impeller by a simple structure.

In order to solve the above describe problem, in accordance with the first aspect of the present invention, a multi-blade centrifugal fan is provided with a fan casing and a multi-blade centrifugal impeller. The fan casing is provided with a bellmouth forming an air intake and an air outlet. The fan casing also has a tongue portion. The multi-blade centrifugal impeller is arranged inside the fan casing and has a number of annularly arranged blades. The impeller blows out air drawn in through the intake which faces the above described bellmouth in the centrifugal direction through the above described blades. In this multi-blade centrifugal fan, a retainer ring for retaining the above described blades is provided in at least one end portion in the axial direction of the above described impeller, and a cylindrical body is integrally provided in such a manner as to extend from the outer end of this retainer ring.

In the above described configuration, air drawn in through the bellmouth passes through the intake and the inside of the impeller so as to be blown out in the centrifugal direction through the blades, and then flows out into the fan casing. At this time, circular flows toward the intake side are prevented in the end portions of the impeller by the cylindrical body, which is integrated with and extends from the outer end of the retainer ring. Accordingly, the efficiency in the blowing of wind is increased, and noise is reduced. In addition, the outer ends of the retainer ring integrally extend, and therefore, the end portions of the impeller 2 are in an open state. Accordingly, it is possible to form the impeller 2 as an integrated mold of a synthetic resin, which greatly reduces in the costs.

The above described cylindrical body may extend and reach a location which is substantially the same as the end of the above described bellmouth on the outlet side, or a location which overlaps with the end on the outlet side. In this case, circular flows toward the intake side are prevented more effectively in the end portion of the impeller.

The above described cylindrical body (11) and the above described retainer ring (10) may be provided in such a manner that the longitudinal cross section of the former linearly extends from the longitudinal cross section of the latter. In this case, formation of the cylindrical body 11 becomes much easier, which further reduces the costs.

The longitudinal cross section of the above described cylindrical body may extend along a circular arc from the longitudinal cross section of the above described retainer rings. This structure is preferable in that blown out air flow is guided smoothly.

A predetermined clearance may be set between the above described cylindrical body and the above described tongue portion. In this case, backflow through the clearance from the tongue portion in the fan casing is effectively prevented.

The above described impeller may be of a one-intake type with an intake only at one end in the axial direction of the impeller. In this case, the configuration of the impeller when formed as an integral mold of a synthetic resin can be made so that the direction in which the mold is removed from the die is one direction, and thus, the work of molding is easy.

A ratio of expansion a of the above described fan casing 1 can be set in a range from 4.0 to 7.0, and in this case, increase in the efficiency of the fan and reduction in the noise during operation are achieved when used with a large air volume.

BEST MODE FOR CARRYING OUT THE INVENTION

Figure 1:
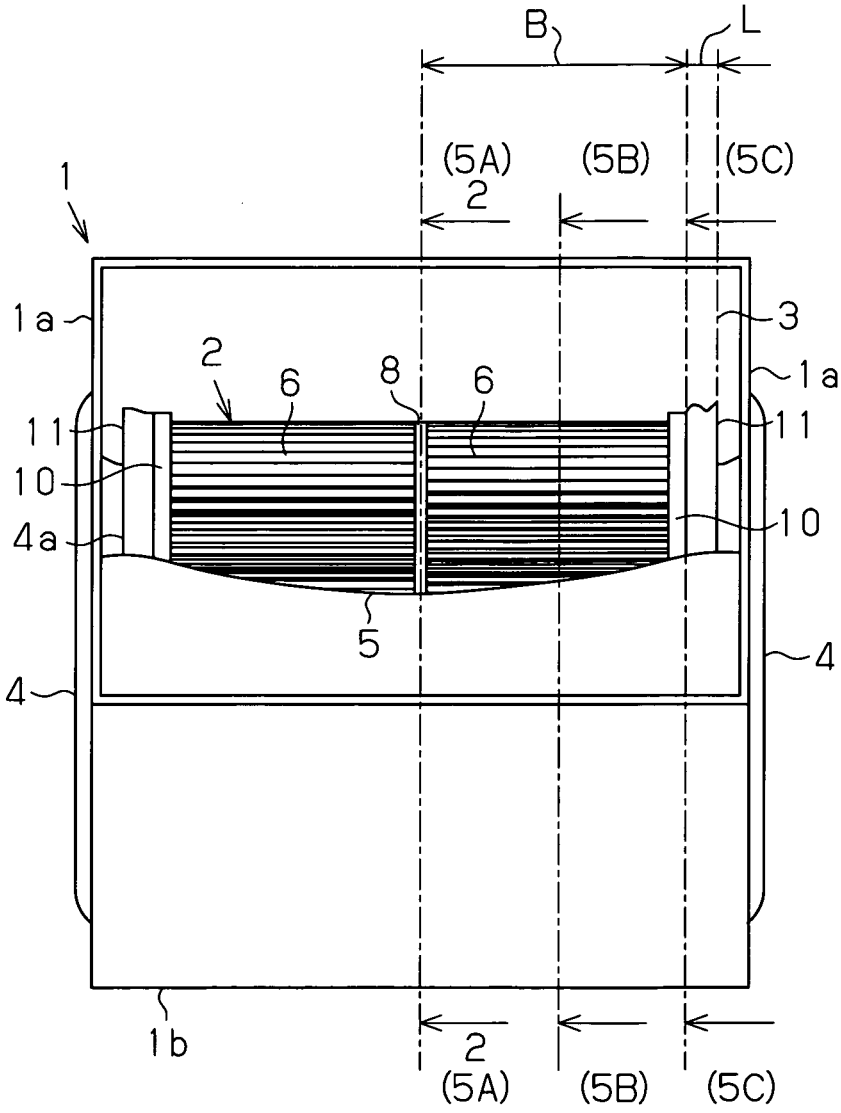
FIG. 1 is a front view showing a multi-blade centrifugal fan according to a first embodiment of the present invention.

In the following, several preferred embodiments of the present invention are described with reference to the accompanying drawings.

First Embodiment

FIGS. 1 to 4 show a multi-blade centrifugal fan according to a first embodiment of the present invention. As shown in FIGS. 1 to 4, this multi-blade centrifugal fan is provided with a fan casing 1 of a scroll type. The fan casing 1 is provided with an air outlet 3, a pair of bellmouths 4 which face each other, and a tongue portion 5. Each bellmouth 4 forms an air intake. A multi-blade centrifugal impeller 2 having a number of annularly arranged blades 6 is placed inside the fan casing 1. Intakes 7 are created at the two ends of the impeller 2 in such a manner as to respectively face the above described bellmouths 4, and air drawn in through these intakes 7 is blown out in the centrifugal direction through the above described blades 6. The tongue portion 5 is a portion of the fan casing 1 at which the clearance between the inner peripheral surface of the fan casing 1 and the outer peripheral surface of the impeller 2 is minimal.

The impeller 2 is provided with a main plate 8, and a bearing 9 is provided in this main plate 8. The rotary shaft of a fan motor (not shown) is supported by the bearing 9. The multi-blade centrifugal fan according to the present embodiment is of a two-intake type with bellmouths 4 on the two side plates 1*a* of the fan casing 1, and the intakes 7 at the two ends of the impeller 2. Each blade 6 is a sweep forward blade in which a proximal end 6*b* is ahead of an inner end 6*a* in the direction of rotation M of the impeller 2.

Figure 13:
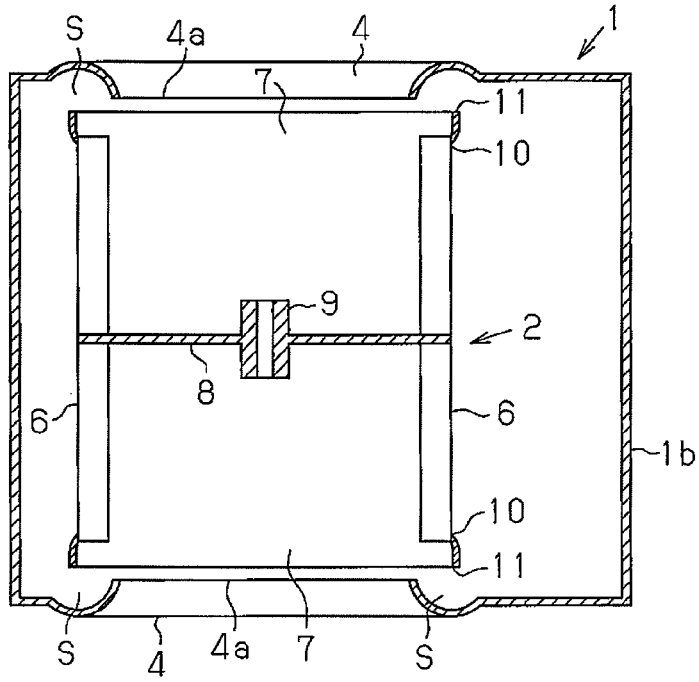
FIG. 13 is a cross-sectional view showing the multi-blade centrifugal fan according to a modification of the first embodiment.

Retainer rings 10 for retaining the above described blades 6 are respectively provided in the two end portions of the above described impeller 2. A cylindrical body 11, which reaches substantially the same location as the end 4*a* of each bellmouth 4 on the outlet side, is integrally provided with and extends from each retainer ring 10. The outer end of each described cylindrical body 11 may reach such a location as to overlap with the end 4*a* of the bellmouth 4 on the outlet side or, as shown in FIG. 13, may be at a distance from the end 4*a* of the bellmouth 4 on the outlet side.

The effects of preventing circular flows are great in the case where the outer ends of the cylindrical bodies 11 reach substantially the same locations as the ends 4*a* of the bellmouths 4 on the outlet side, or in the case where the outer ends of the cylindrical bodies 11 reach such a location as to overlap with the ends 4*a* on the outlet side, and slightly inferior in the case where the outer ends of the cylindrical bodies 11 reach such locations as to be at a distance from the ends 4*a* of the bellmouths 4 on the outlet side.

Furthermore, the above described bellmouths 4 bulge outward from the side plates 1*a* of the fan casing 1. In this case, an annular space S is formed inside each bellmouth 4.

Figure 3:
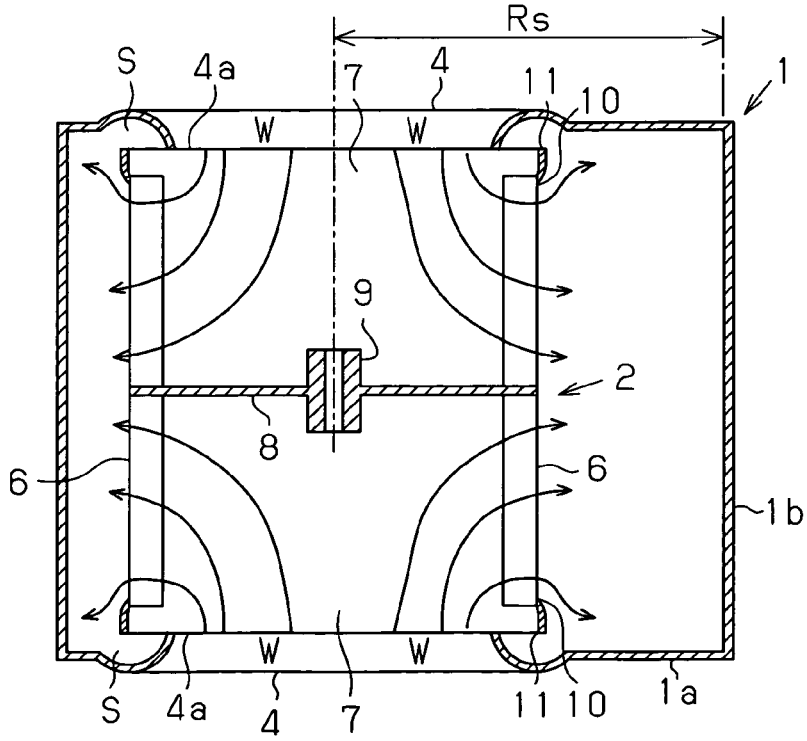
FIG. 3 is a cross-sectional view taken along line 3-3 in FIG. 2.
Figure 4:
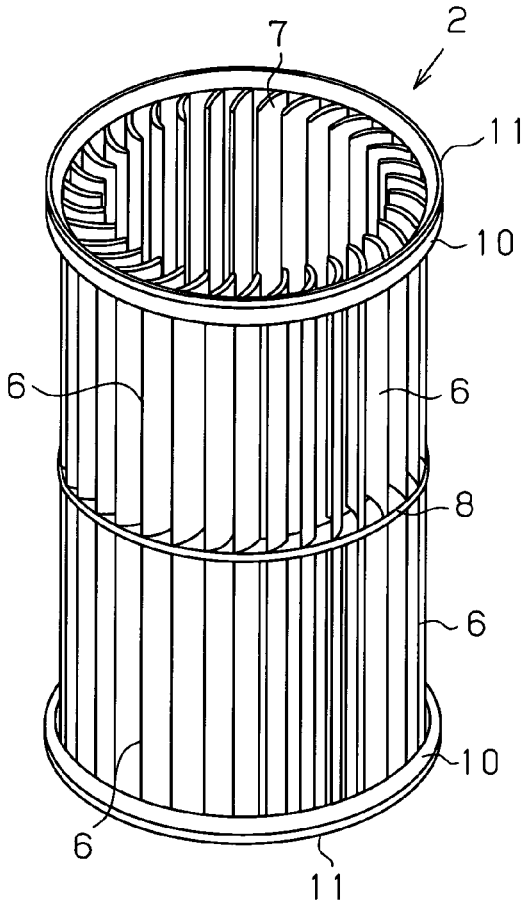
FIG. 4 is a perspective view showing the impeller in the multi-blade centrifugal fan according to the first embodiment.
Figure 5:
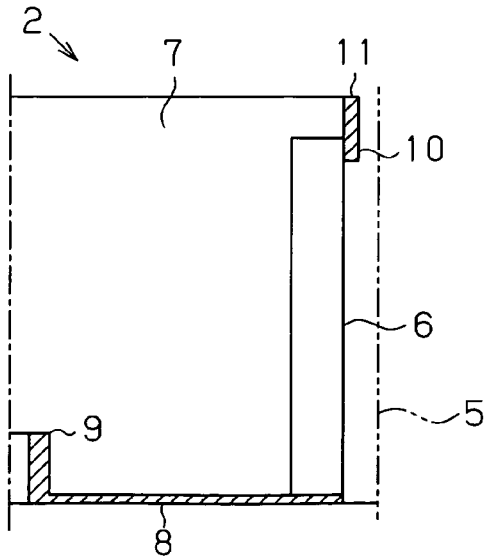
FIG. 5 is a cross-sectional view showing a main portion of the cylindrical body in the impeller of the multi-blade centrifugal fan according to a modification of the first embodiment.
Figure 6:
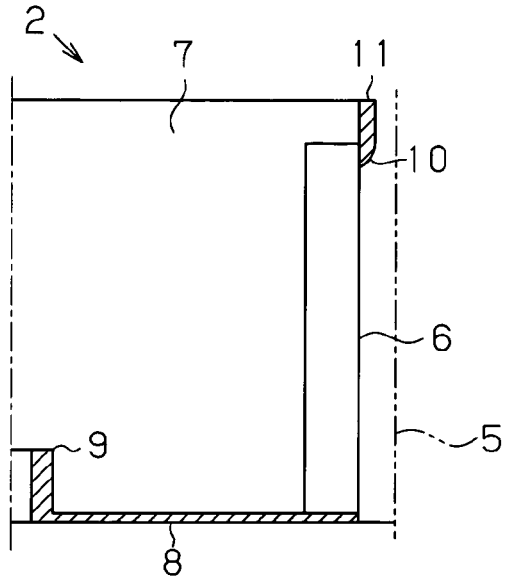
FIG. 6 is a cross-sectional view showing a main portion of the cylindrical body in the impeller of the multi-blade centrifugal fan according to another modification of the first embodiment.

In the present embodiment, as shown in FIG. 3, the longitudinal cross section of the above described cylindrical body 11 extends in a circular arc form from the longitudinal cross section of the above described retainer rings 10. This configuration is preferable in that the flow of blown out air is guided smoothly. As shown in FIG. 5, the longitudinal cross section of the above described cylindrical body 11 may extend linearly from the longitudinal cross section of the above described retainer rings 10. This configuration makes it easy to secure a clearance D from the inner peripheral surface of the tongue portion in the fan casing 1. Furthermore, as shown in FIG. 6, the longitudinal cross section of the above described cylindrical body 11 may extend in a circular arc form from the longitudinal cross section of the above described retainer ring 10, and further extend linearly. This configuration secures a clearance from the inner peripheral surface of the tongue portion 5 in the fan casing 1, and makes it easy to guide the flow of intake.

Figure 7:
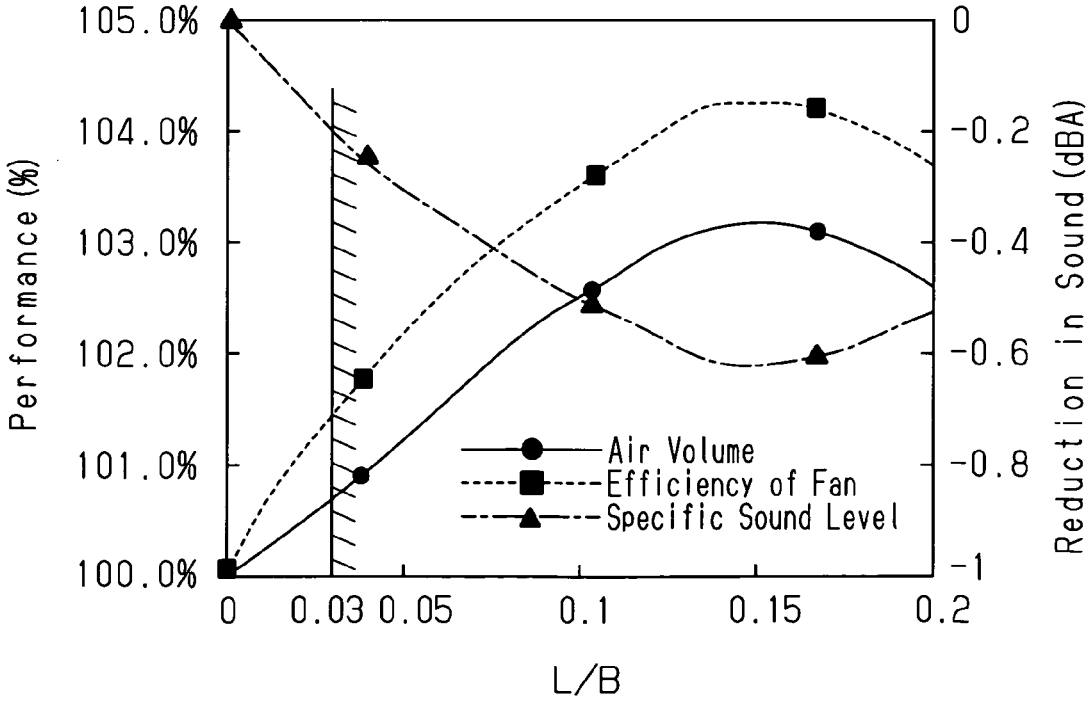
FIG. 7 is a characteristic graph showing changes in the performance of the fan when the ratio L/B of the length L of the cylindrical body to the length B of the blades starting from the main plate is changed in the multi-blade centrifugal fan according to the first embodiment.
Figure 8:
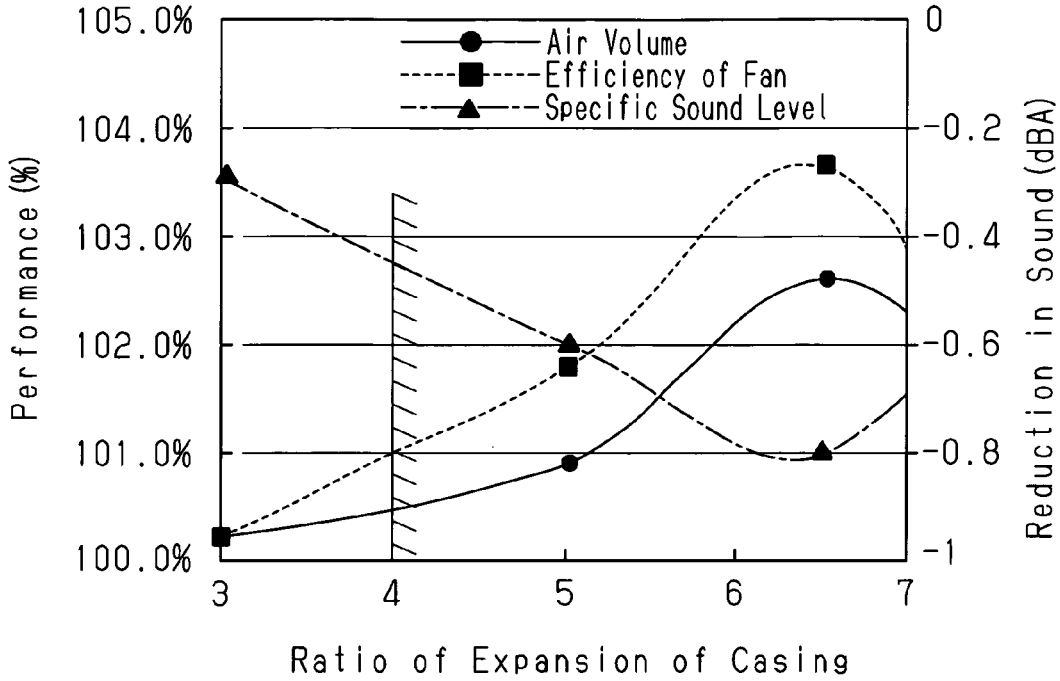
FIG. 8 is a characteristic graph showing changes in the performance of the fan when the ratio of expansion $\alpha$ of the fan casing in the multi-blade centrifugal fan according to the first embodiment is changed.

Tests were conducted to find out the performance of the multi-blade centrifugal fan having the above described configuration, by changing the ratio L/B of the length L of the cylindrical body 11 to the length B of the blades 6 starting from the main plate 8 (see FIG. 1), and the ratio of expansion $\alpha$ of the fan casing 1, and the results shown in FIGS. 7 and 8 were gained. Although in the present embodiment, the peripheral surface 1*b* of the fan casing 1 is an Archimedean spiral, the same results can be gained in the case of a logarithmic spiral.

The ratio of expansion $\alpha$ of the fan casing corresponds to the spread angle of the spiral, and is represented by the following expression.

$$Rs(\theta s)=r\cdot\exp(\theta s\cdot\tan\alpha)$$

The sign r represents the reference minimum radius of the spiral (see FIG. 2), the sign Rs represents a radius in accordance with the angle $\theta s$ of the spiral, and the sign $\theta s$ represents the angle of the spiral relative to the origin corresponding to the reference radius of the spiral.

It was found out from the above described results that the efficiency of the fan is high and the specific sound level is low when L/B is in a range from 0.03 to 0.2. In the case of $L/B \geqq 0.2$, the gap between the cylindrical body 11 and the inner peripheral surface of the fan casing 1 becomes small, and therefore, the efficiency of the fan lowers and the specific sound level becomes high. In addition, when the ratio of expansion a of the casing becomes great, the clearance D between the cylindrical body 11 and the inner peripheral surface of the fan casing 1 becomes large, and the Coanda effect due to the cylindrical body 11 becomes greater. In the case where the ratio of expansion $\alpha$ of the casing becomes too great, the performance lowers. Accordingly, it is desirable to set the ratio of expansion $\alpha$ of the above described fan casing 1 in a range from 4.0 to 7.0. In this configuration, increase in the efficiency of the fan and reduction in noise during operation are achieved when used with a large air volume.

Figure 2:
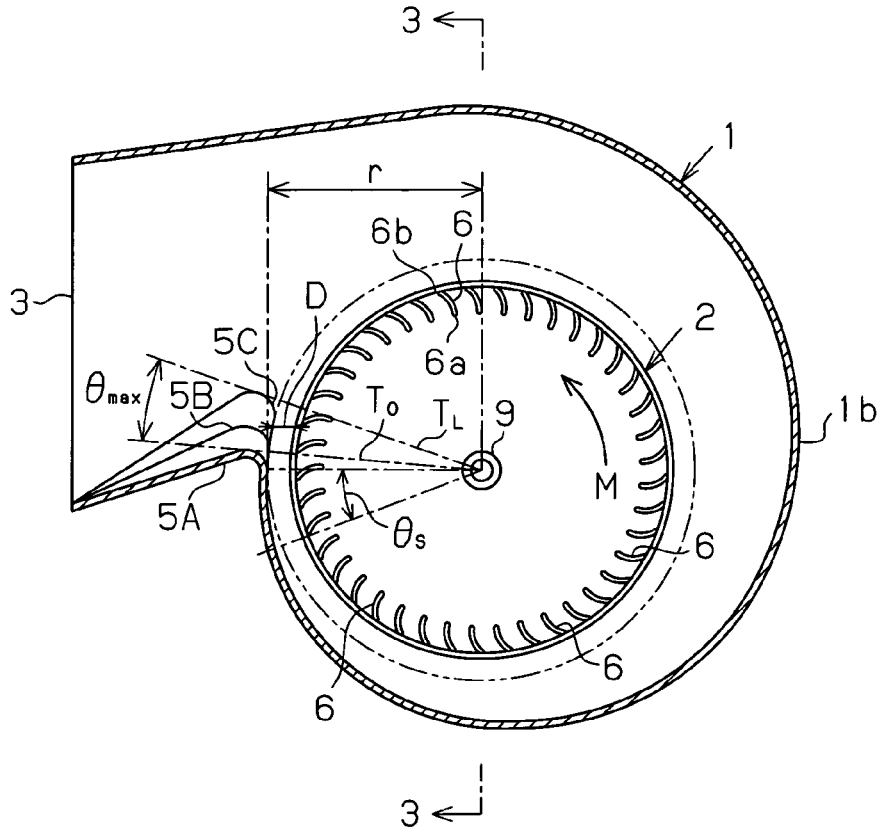
FIG. 2 is a cross-sectional view taken along line 2-2 in FIG. 1.

Incidentally, as shown in FIGS. 1 and 2, the outer form of the above described tongue portion 5 smoothly changes in the axial direction of the impeller 2 from the retainer rings 10 toward the main plate 8, so that the ridge line of the tongue portion 5 is in a V shape as a whole. The tongue portion 5A in FIG. 2 corresponds to the cross section along line 5A-5A in FIG. 1 which passes through the main plate 8 of the impeller 2, the tongue portion 5B corresponds to the cross section along line 5B-5B in FIG. 1, and the tongue portion 5C corresponds to the cross section along line 5C-5C in FIG. 1.

In addition, in FIG. 2, the form of the tongue portion 5 is shown using the angle θ formed between the reference line T0, which passes through the apex in the lateral cross section of the tongue portion 5A and the center of rotation of the impeller 2, and an imaginary line TL, which passes through the center of rotation of the impeller 2 and the apex of the tongue portion 5 in the lateral cross section in any location in the axial direction.

Figure 9:
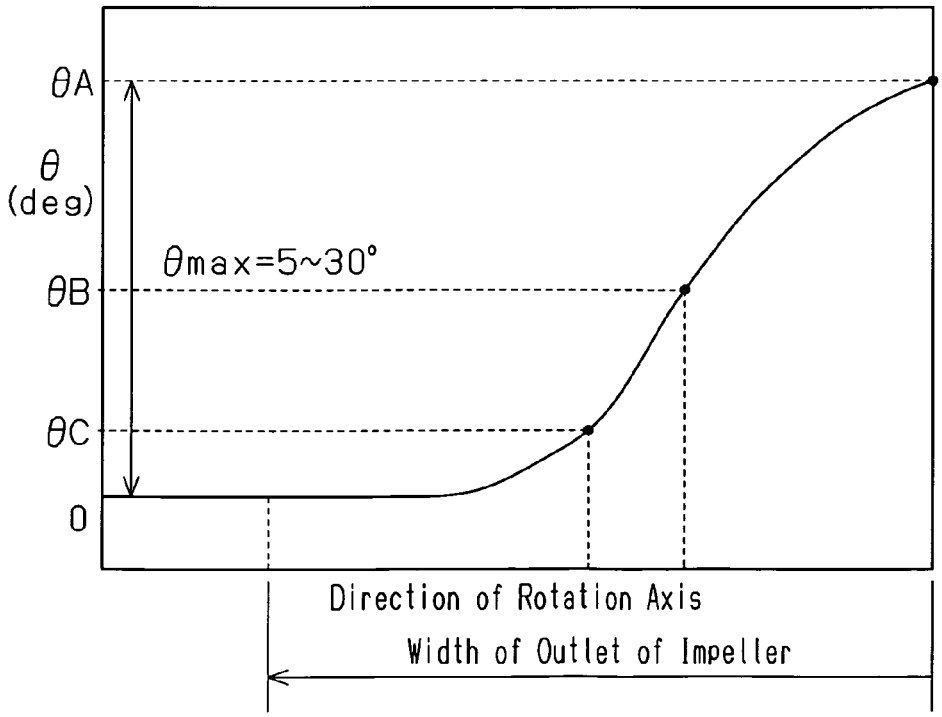
FIG. 9 is a characteristic graph showing the location of the tongue portion of the fan casing relative to the width of the outlet of the impeller in the multi-blade centrifugal fan according to the first embodiment.

In this case, the angle θ in the tongue portion 5A is zero degrees. As shown in FIG. 9, at the width of the outlet of the impeller 2, the angle θ of the tongue portion 5 changes from zero degrees to an angle θA through an angle θC and an angle θB from the main plate 8 of the impeller 2 to the cylindrical body 11. It is desirable for the maximum value θmax of the angle θA to be in a range from 5° to 30°. This configuration secures a predetermined clearance D between the outer peripheral surface of the cylindrical body 11 and the tongue portion 5 and prevents backflow of air into the impeller 2, so that the performance in terms of blowing wind is increased, and turbulent noise resulting from the rotation of the impeller 2 is reduced.

Second Embodiment

Figure 10:
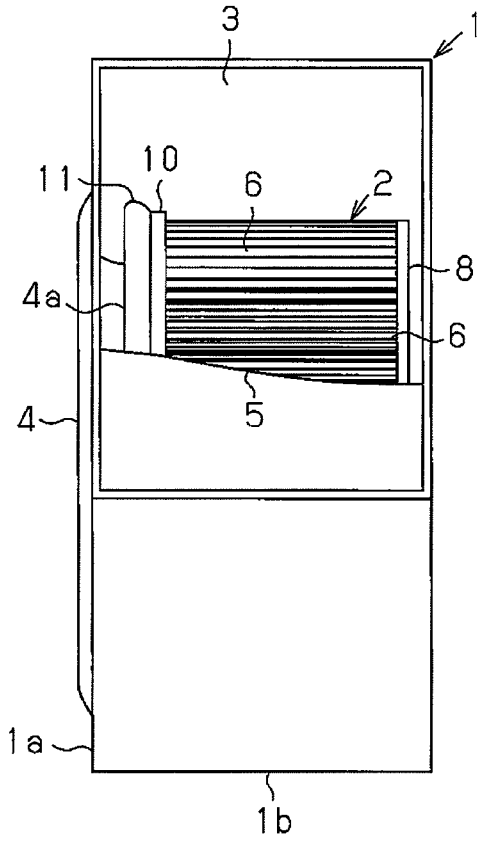
FIG. 10 is a front view showing the multi-blade centrifugal fan according to a second embodiment.
Figure 11:
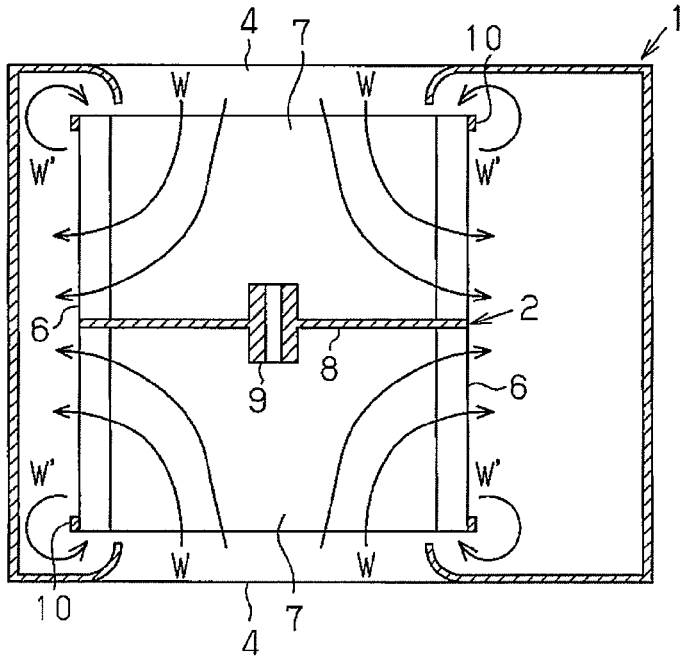
Fig.11 (Prior Art)
FIG. 11 is a cross-sectional view showing a conventional multi-blade centrifugal fan.
Figure 12:
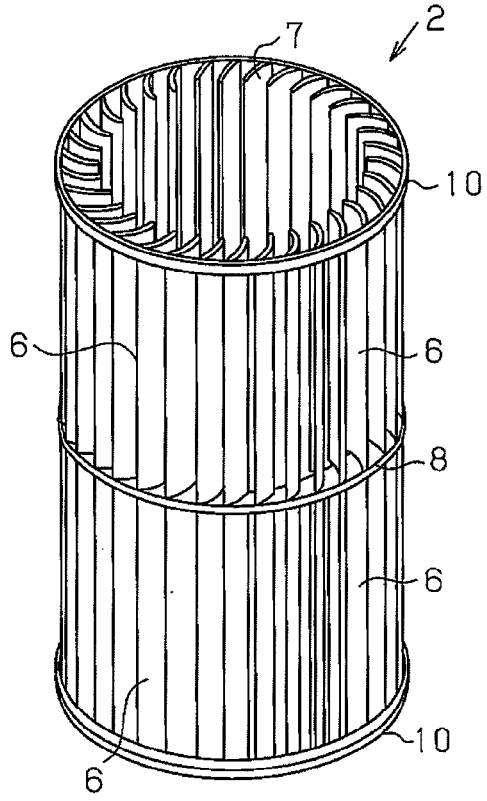
Fig.12 (Prior Art)
FIG. 12 is a perspective view showing the impeller in the conventional multi-blade centrifugal fan.

FIG. 10 shows a multi-blade centrifugal fan according to a second embodiment of the present invention.

This centrifugal fan is of a one-intake type and has a bellmouth 4 and an intake 7. The bellmouth 4 is located in the side plate 1*a* on the left side of the fan casing 1 and serves as an air intake. The intake 7 is located on the left end of the impeller 2 in FIG. 10. In this case, the height of the tongue portion 5 relative to the lower end 3*a* of the air outlet 3 is smoothly reduced toward the main plate 8 from the retainer ring 10 in the direction of rotation of the impeller 2 so that the entirety becomes inclined. This configuration makes the direction in which the mold is released one direction when the impeller 2 is formed of an integrated mold of a synthetic resin, and thus, the work of molding becomes easy. The other parts in the configuration and the advantages are the same as in the first embodiment, and therefore, the descriptions thereof are omitted.

It should be noted that the present invention is not restricted to each of the foregoing embodiments and a part of the structure can be appropriately changed and embodied without departing from the scope of the invention.

The invention claimed is:

1. A multi-blade centrifugal fan, comprising a fan casing having a pair of opposed side plates and a multi-blade centrifugal impeller, wherein the fan casing is provided with a pair of opposed bellmouths each forming an air intake and an air outlet, and has a tongue portion, wherein the multi-blade centrifugal impeller is arranged inside the fan casing and has a number of annularly arranged blades, the multi-blade centrifugal impeller draws in air through an intake which faces each of the bellmouths and blows the air out in the centrifugal direction through the blades, wherein each end portion of the impeller in the axial direction is provided with a retainer ring for retaining the blades, and a cylindrical body is integrally provided in such a manner as to extend from an outer end of each retainer ring, wherein each of the bellmouths bulges outward from a respective one of the side plates of the fan casing and an annular space is formed inside each of the bellmouths, and wherein a longitudinal cross section of each cylindrical body extends in a circular arc form from a longitudinal cross section of each retainer ring such that a diameter of an outer peripheral surface of each cylindrical body gradually increases toward each of the bellmouths.

2. The multi-blade centrifugal fan according to claim 1, wherein the cylindrical body extends and reaches a location which is substantially the same as an end of the bellmouth or such a location as to overlap with the end.

3. The multi-blade centrifugal fan according to claim 1, wherein a predetermined clearance exists between the cylindrical body and the tongue portion.

4. The multi-blade centrifugal fan according to claim 1, wherein the ratio of expansion of the fan casing is set in a range from 4.0 to 7.0.

5. The multi-blade centrifugal fan according to claim 1, wherein the cylindrical body is arranged at a distance from an end of the bellmouth.

* * * * *